US006765536B2

(12) United States Patent
Phillips et al.

(10) Patent No.: US 6,765,536 B2
(45) Date of Patent: Jul. 20, 2004

(54) ANTENNA WITH VARIABLY TUNED PARASITIC ELEMENT

(75) Inventors: James P. Phillips, Lakes in the Hills, IL (US); Christopher P. Cash, Woodstock, IL (US); Jeffrey Y. Ho, Palm Bay, FL (US); Narenda Pulimi, Rolling Meadows, IL (US); Paul W. Reich, Glendale Heights, IL (US); Roger L. Scheer, Crystal Lake, IL (US)

(73) Assignee: Motorola, Inc., Schaumburg, IL (US)

( * ) Notice: Subject to any disclaimer, the term of this patent is extended or adjusted under 35 U.S.C. 154(b) by 2 days.

(21) Appl. No.: 10/141,715

(22) Filed: May 9, 2002

(65) Prior Publication Data

US 2003/0210206 A1 Nov. 13, 2003

(51) Int. Cl.[7] ..... H01Q 1/24; H01Q 1/36
(52) U.S. Cl. ..... 343/702; 343/745; 343/895
(58) Field of Search ..... 343/702, 745, 343/748, 833, 844, 850, 895, 834

(56) References Cited

U.S. PATENT DOCUMENTS

| | | | | |
|---|---|---|---|---|
| 4,442,438 A | | 4/1984 | Siwiak et al. | |
| 4,494,122 A | | 1/1985 | Garay et al. | |
| 4,631,546 A | * | 12/1986 | Dumas et al. | 343/833 |
| 4,800,395 A | | 1/1989 | Balzano et al. | |
| 4,939,525 A | | 7/1990 | Brunner | |
| 5,572,223 A | | 11/1996 | Phillips et al. | |
| 5,754,146 A | | 5/1998 | Knowles et al. | |
| 5,767,807 A | * | 6/1998 | Pritchett | 343/834 |
| 5,923,305 A | * | 7/1999 | Sadler et al. | 343/895 |
| 6,081,700 A | | 6/2000 | Salvi et al. | |
| 6,107,970 A | * | 8/2000 | Holshouser et al. | 343/702 |
| 6,448,942 B2 | * | 9/2002 | Weinberger et al. | 343/895 |

FOREIGN PATENT DOCUMENTS

| | | |
|---|---|---|
| EP | 0635898 B1 | 1/1995 |
| JP | 05136623 A | 6/1993 |
| JP | 06037531 A | 2/1994 |
| WO | WO 97/11507 A1 | 3/1997 |
| WO | WO 98/10485 A1 | 3/1998 |
| WO | WO 99/14819 A1 | 3/1999 |
| WO | WO 99/54956 A2 | 10/1999 |

* cited by examiner

*Primary Examiner*—Michael C. Wimer
(74) *Attorney, Agent, or Firm*—Brian M. Mancini

(57) ABSTRACT

A multi-band radio communication device with an antenna system that includes an antenna element and a parasitic element located in proximity to the antenna element. A tuning circuit is coupled to the parasitic element. The tuning circuit is variable to adjust the parasitic load on the antenna element to provide variable operating frequencies and bandwidths for the communication device.

19 Claims, 4 Drawing Sheets

ANTENNA WITH VARIABLY TUNED PARASITIC ELEMENT

FIELD OF THE INVENTION

This invention generally relates to antennas. More specifically, this invention relates to an antenna coupled with a parasitic element.

BACKGROUND OF THE INVENTION

As the technology for cellular telephones advances, more operating modes and operating frequency bands are becoming available. Making a cellular telephone operable for all of these modes and at all of these frequencies places great demands on the performance of cellular telephone antenna system. In particular, multi-mode and multi-band cellular systems are demanding greater operation bandwidths for antenna systems. Short helical antennas and other small antennas have too narrow of a band of operation to cover the spectrum required of multi-band telephones, particularly when the antenna is coupled with conductive surfaces or planes in proximity to the antenna.

One solution for providing increased bandwidth is to provide a larger antenna element. However, the demand is for smaller sized telephones which makes this solution impractical. Another solution is to reduce the efficiency of the antenna. However, the efficiency of the cellular telephone antenna significantly impacts the amount of energy needed to send and receive signals. If an antenna is inefficient, the power amplifier of a cellular telephone has to produce a higher power signal to overcome the inefficiency of the antenna, which undesirably shortens battery life. Moreover, on the receive side of operation, the sensitivity of the cellular telephone is impacted by the efficiency of the antenna.

Furthermore, cellular telephones are increasingly designed to operate via more than one frequency band. An antenna system can be required to operate from a lower frequency band of operation of about 800 MHz up to a higher frequency band of operation of 2 GHz or more. This places great demands on antenna systems and is difficult to accomplish with conventionally.

Therefore, there is a need for an improved antenna system that is operable at multiple frequency bands without impacting antenna efficiency. There is a further need for an efficient antenna structure with a bandwidth large enough to operate efficiently over the required cellular frequency bands of operation.

DETAILED DESCRIPTION OF PREFERRED EMBODIMENTS

Figure 1:
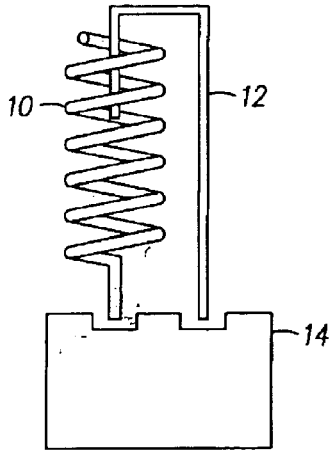
FIG. 1 is a representation of a first, preferred embodiment of an antenna apparatus, in accordance with the present invention.

The present invention provides an improved antenna system that is operable at multiple frequency bands without impacting antenna efficiency. An efficient antenna structure is provided with a bandwidth large enough to cover the required cellular frequency bands of operation. This is accomplished by coupling an antenna element with an active, variably tuned parasitic element. In particular, the present invention uses at least one conductor located proximally to the antenna element. This parasitic conductor is electromagnetically coupled to tuning elements to expand the bandwidth of the antenna system by tuning the frequency band response of the antenna element across a wider spectral range. Bandwidth improvements of up to 6:1 have been achieved.

The addition of a passive parasitic element to a radio communication device is known in the art and has been shown to accomplish an increased bandwidth for a selected frequency band. One major obstacle to the use passive parasitics is their non-optimal performance at different frequency bands. The present invention provides a tunable parasitic element with circuitry to provide increased operational bandwidth at several frequencies. The addition of separate tuning circuitry for the antenna element itself can maintain efficiency in response to operational frequency and impedance changes caused by the parasitic tuning itself. The tuning circuitry for the parasitic element is driven by the operating frequency and impedance presented. Advantageously, this capability broadens the usable bandwidth of the antenna system at different frequencies, combating the bandwidth narrowing affect of a small antenna.

The invention will have application apart from the preferred embodiments described herein, and the description is provided merely to illustrate and describe the invention and it should in no way be taken as limiting of the invention. While the specification concludes with claims defining the features of the invention that are regarded as novel, it is believed that the invention will be better understood from a consideration of the following description in conjunction with the drawing figures, in which like reference numerals are carried forward. The antenna embodiments described below are for use with a cellular telephone or other portable, wireless radiotelephone communication device. A conventional cellular telephone includes a transceiver including a transmitter for transmitting signals, a receiver for receiving signals, a synthesizer coupled to the transmitter and receiver for generating carrier frequency signals, and a controller for controlling operation of the cellular telephone. As defined in the invention, a radiotelephone is a communication device that communicates information to a cellular base station using electromagnetic waves in the radio frequency range. In general, the radiotelephone is portable and battery powered.

The present invention utilizes at least one conductor (parasitic element), in close proximity to a transmitting and/or receiving directly connected (driven) antenna, to electromagnetically couple a tunable load to perturb the antenna's resonant frequency. The tuning load can include a singular or variable reactive load between the parasitic element and ground. Placement, shape and length of the parasitic element vary with the type of antenna used, the type of coupling being utilized, and the amount of coupling desired between the element and the antenna. The types and geometries of antennas that can be used are limited only by the ability to produce sufficient coupling between the antenna and parasitic element to allow tunability of the antenna. In addition, more than one parasitic element can be used. Moreover, the one or more parasitic elements can be used to couple to more than one antenna element.

Two families of embodiments will be described utilizing two types of coupling mechanisms, in accordance with the present invention. The first family of embodiments utilizes electric field or capacitive coupling between the antenna and parasitic element. With capacitive coupling, RF energy is transferred between the antenna and parasitic element through the electric field surrounding the antenna in the same way that energy is transferred between the two plates of a capacitor. Parasitic element geometries utilizing capacitive coupling are generally in close proximity to a portion of the antenna element. These parasitic elements are connected to a tuning load at one end and terminate without a direct connection to the antenna or ground at the opposite end. Straight or bent wire monopole-like elements and small diameter helical monopole-like elements are two examples of capacitive coupling parasitic elements.

The second type of coupling mechanism included in this invention is magnetic field or inductive coupling. Parasitic element geometries that utilize inductive coupling transfer RF energy between the parasitic element and antenna element through the magnetic field surrounding the antenna element. The family of embodiments that utilize inductive coupling contain parasitic elements that are in close proximity to a portion of the antenna. These parasitic elements are connected to a tuning load at one end, as with the capacitively coupled elements, but grounded at the opposite end. Inductively coupled parasitic elements form a magnetic loop that is grounded at one end with the tuning device or circuit between the parasitic element and ground at the other end.

FIG. 1 is a representation of a first, preferred embodiment of an antenna apparatus with a capacitively coupled parasitic element. In practice, the antenna structure is supported and encapsulated in nonconductive materials, as is known in the art. For example, dielectrics and plastics are commonly used to accomplish this purpose. These are not shown to simplify the figures. The antenna structure includes an antenna element 10 and a parasitic element 12 located in proximity to the antenna element. Both structures are mounted on top of a vertical ground plane 14, which comprises one or more of a printed circuit board with a metalized ground plane, a conductive housing of the communication device utilizing the antenna apparatus, or other conductive element of the communication device. The conductive portions and the antenna structures are coupled to the communication device through conventional means, as is known in the art.

Either of the antenna element and the parasitic element can be a helix or a straight wire. The electrical length of the antenna element 10 is selected to be near a quarter-wavelength, $\lambda/4$, where $\lambda$ is the wavelength corresponding to the desired (resonant) frequency of operation of the communication device. However, the length of the helix and the spacing between coils can be adjusted with the parasitic element in place to obtain a desired frequency range. Preferably, the antenna element 10 is a helix, and the coupled parasitic element 12 is a wire that rises substantially parallel to the outside of the helix and then extends over the top and down into the helical structure of the antenna element. Several design parameters affect the actual physical length selected far the parasitic element and the helical antenna element. For example, the diameter of the helical turns will alter the necessary physical length as is known to those skilled in the art. Further, coupling between the antenna element 10 and the parasitic element 12 can be varied by controlling the diameter of the parasitic element and the length that the parasitic element protrudes into the center of the helix of the antenna element.

Figure 2:
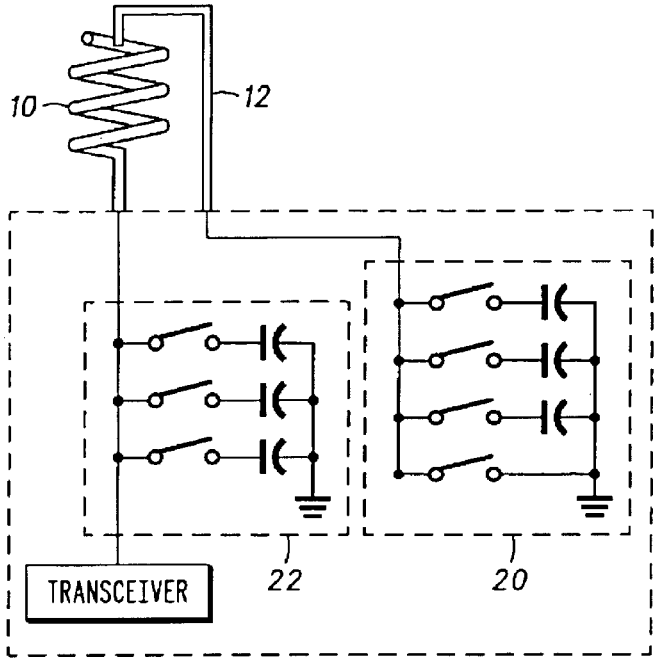
FIG. 2 is a simplified block diagram of a tuning circuit for use with the preferred embodiments of the present invention.

As shown in FIG. 2, a tuning circuit 20 is coupled to the parasitic element 12. The overall functions of the tuning circuit are to improve bandwidth and allow a normally narrow bandwidth antenna to sweep across a wider bandwidth. The function of the switching circuit is to provide a variable load to be mutually coupled to the driven antenna element 10 through the parasitic element 12.

Preferably, a variable matching circuit 22 can be used in addition to the tuning circuit 20 to enhance antenna efficiency. When required, the variable matching circuit 22 compliments the parasitic tuning circuit 20 by rematching the feed to the antenna element 10 to the retuned impedance of the antenna/parasitic element system. The number and type of tuning elements in the matching circuit 22 depends on the type and size of the antenna used and the frequency range covered. In practice, the variable matching circuit 22 utilizes the same type of switching circuitry described for the tuning circuit 20.

The variable tuning circuit 20 connected to the parasitic element 12 utilizes an RF switching device to enable a variety of capacitive or inductive tuning components to be selected or combined in order to adjust the reactive load on the parasitic element. A high Q resonant switching circuit is desired in order to provide good tuning selectivity and low loss. The ideal switching device for this purpose would have very low ON resistance, very high isolation properties in the OFF state, and be completely linear throughout the desired frequency range. Several RF switching devices could be adapted for use in the variable tuning circuit. Examples of such devices are: MicroElectroMechanical Systems (MEMS), PIN diodes, voltage variable capacitors (VVCs), and pseudomorphic high electron mobility transistors (PHEMTs). PIN diodes are preferred in this invention because of their availability and widespread use, their relative linearity, moderately low ON resistance, and moderately high OFF state isolation.

Figure 3:
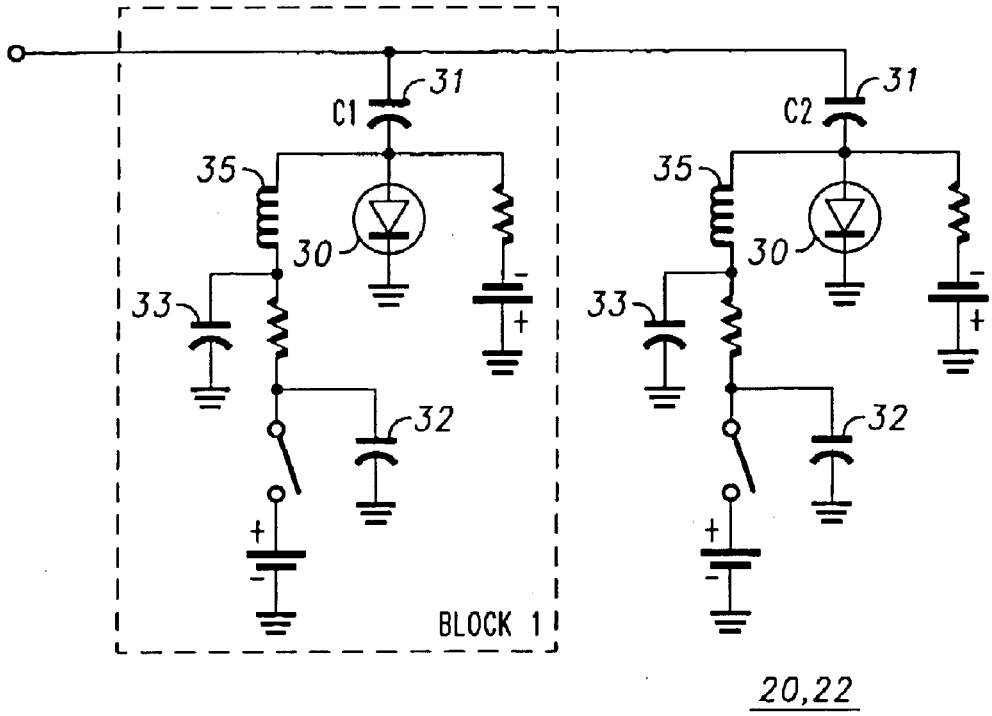
FIG. 3 is a circuit diagram of the tuning circuit of FIG. 2.

FIG. 3 is a schematic of the tuning circuit 20 of FIG. 2 used with the preferred capacitively coupled and magnetically coupled embodiments of the present invention. Two PIN diode blocks are shown allowing up to four unique tuning loads (i.e. four combinations of C1 and C2) to be switched onto the parasitic element. Additional tuning states can easily be added to cover more frequency bands or to achieve broader bandwidth coverage from a single antenna structure by repeating the basic PIN diode block (Block 1) with suitable values in place of capacitor C1. There are several parameters of concern when using PIN diode switching. Since a low on-resistance PIN diode has relatively high Q, the forward bias resistance will primarily determine the circuit Q. PIN diode intermodulation distortion (IMD) is usually characterized by linearity versus loss tradeoffs. A low IMD (good linearity) PIN diode has larger on-resistance and smaller junction capacitance, leading to higher loss at the same forward bias current. A high IMD (poor linearity) PIN diode has smaller on-resistance and larger junction capacitance, leading to lower loss at the same forward bias current. The PIN diode component selection is a compromise based on its on-resistance, junction capacitance, and IMD vs. power level performance.

The two-stage PIN diode circuit shown is comprised of two shunt PIN diodes 30 combined with fixed-value capacitors 31–33. This combination provides four states of switched capacitance. Additional switching blocks can be added to increase the degree of tuning capability. A decoupling circuit consisting of an RF choke 35 and decoupling capacitors 32, 33 that isolate RF from the DC bias circuit. The RF choke 35 also serves to cancel out capacitance in order to minimize the affect of the PIN diode junction capacitance.

Circuit analysis of the PIN-diode switching network was performed to determine the actual capacitive loading and circuit impedance presented at the parasitic element. The PIN diode was modeled as a nonlinear model and included the package parasitics. Capacitor values used in the described circuit were $C_1$=0.5 pF and $C_2$=1.3 pF. S-parameter simulation was performed to demonstrate capacitance at various switching states. Simulated results at 900 MHz are summarized in Table 1. A prototype of the PIN-diode switching circuit was built, using the same values as the simulated model, to characterize circuit impedance and capacitance. The prototype measured higher capacitance compared to the ideal circuitry of the simulated model but the trends predicted in the model were present in the physical circuit. Measured parameters are summarized in Table 1.

TABLE 1

PIN diode switching results

| Switching | Simulated Results | | Measured Results | |
|---|---|---|---|---|
| States | Load Impedance | Capacitance | Load Impedance | Capacitance |
| D1 off, D2 off | Z = 11.63 − j333.5 Ω | C = 0.53 pF | Z = 4.83 − j138.77 Ω | C = 1.27 pF |
| D1 on, D2 off | Z = 1.12 − j128.74 Ω | C = 1.37 pF | Z = 1.88 − j81.52 Ω | C = 2.17 pF |
| D1 off, D2 on | Z = 0.57 − j75.55 Ω | C = 2.34 pF | Z = 1.28 − j45.96 Ω | C = 3.85 pF |
| D1 on, D2 on | Z = 0.22 − j56.90 Ω | C = 3.11 pF | Z = 0.97 − j36.50 Ω | C = 4.84 pF |

Circuit analysis was then performed to determine the antenna/load losses and radiated efficiency affects of the tuning circuit. Measured impedance loads of the switching circuit were used to predict the circuit's loss in the presence of the tunable antenna apparatus shown in FIG. 1. Ground plane dimensions and antenna geometry were modeled to obtain a resonant frequency of 900 MHz with a bandwidth of 60 MHz. The parasitic element was terminated into the variable Z-parameter load described above. The helical antenna's input impedance, antenna/load losses, and radiation efficiency were then calculated. Simulated results are summarized below.

TABLE 2

Antenna apparatus simulation results

| Switching States | Antenna Impedance | Impedance Load | Total Losses | Efficiency |
|---|---|---|---|---|
| D1 & D2 off | 28.4 − j16.9 Ω | 199.9 − j828.3 Ω | 0.46 dB | 90.0% |
| D1 on, D2 off | 18.2 + j4.1 Ω | 3.13 − j139.3 Ω | 0.17 dB | 96.2% |

TABLE 2-continued

Antenna apparatus simulation results

| Switching States | Antenna Impedance | Impedance Load | Total Losses | Efficiency |
|---|---|---|---|---|
| D1 off, D2 on | 15.6 + j12.1 Ω | 1.49 − j61.37 Ω | 0.18 dB | 95.9% |
| Dl & D2 on | 14.8 + j14.4 Ω | 0.65 − j44.12 Ω | 0.16 dB | 96.4% |

As can be seen, the present invention is effective in maintaining antenna efficiency.

Figure 4:
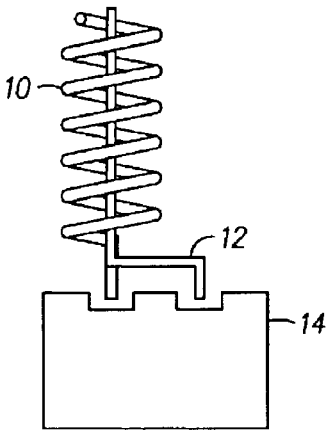
FIG. 4 is a representation of a second embodiment of an antenna apparatus, in accordance with the present invention.

Alternative embodiments of the capacitively coupled tunable antenna can be generated by changing the direction, size, shape, positioning or type of the parasitic element or antenna. One specific alternative embodiment is shown in FIG. 4. In this embodiment, the variable tuning circuit (20 of FIG. 2) is still connected between the parasitic element and ground (not shown) but the element has been redirected to enter the internal space of the helix at the bottom and extends upwards through a portion of the helical structure of the antenna element and parallel to an axis thereof. Preferably, the parasitic element traverses the length of the helix on the inside. Capacitive coupling of this alternative configuration is similar to that of the first, preferred embodiment.

Figure 5:
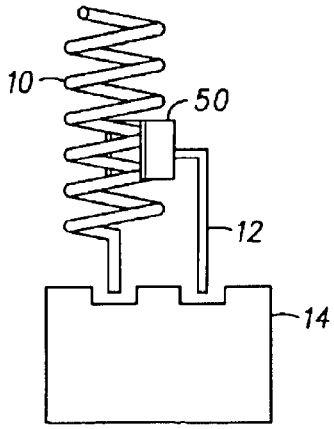
FIG. 5 is a representation of a third embodiment of an antenna apparatus, in accordance with the present invention.

Another alternative embodiment of the capacitively coupled tunable antenna is a parasitic plate configuration, as shown in FIG. 5. The parasitic element 12 for this configuration includes a plate 50, preferably curved to follow the circumference of the helix of the antenna element 10, positioned at the lower end of the driven antenna element 10. Preferably, the plate element 50 of this embodiment covers one to three turns of the antenna element 10 and extends from 45 to 270 degrees around the circumference of the helix. Variations of this configuration can be envisioned with plate elements of various widths and degrees around a driven antenna element of a variety of types. The switched tuning circuit (20 of FIG. 2) connects to the feed of the parasitic plate to allow the element to tune the resonance of the driven antenna element.

Figure 11:
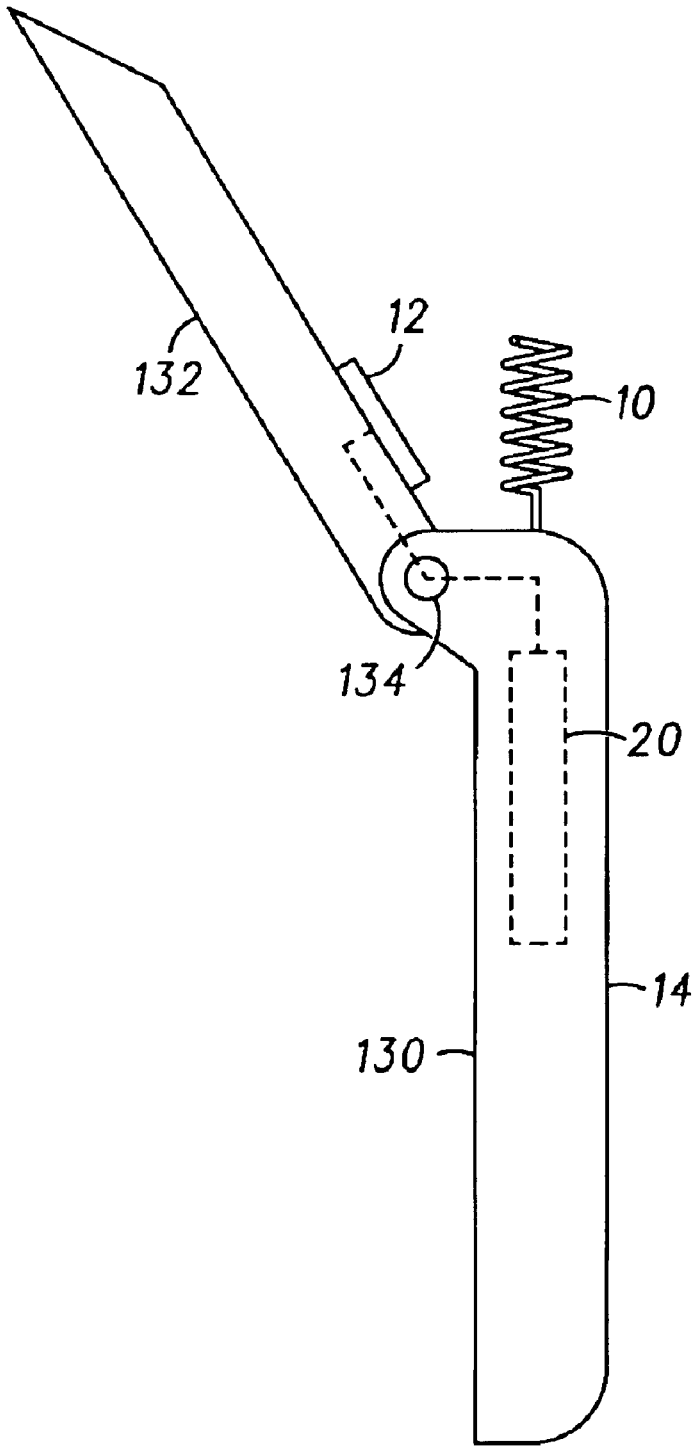
FIG. 11 is a side view of a sixth embodiment of an antenna apparatus, in accordance with the present invention.

Similarly, the parasitic element 12 can be disposed on a flip portion 132 of a housing FIG. 11 of the communication device 130 that comes in close proximity to the antenna element 10 when in the flip 132 is in the open position. This is particularly useful when the flip portion is itself conductive and changes the antenna element emission characteristics (i.e. reduces its bandwidth). In this case, the parasitic element 12 is disposed on a non-conducting portion of the flip 132. By itself, a parasitic element that is unconnected to ground at both ends will have optimum performance when its effective length is about one-half wavelength of the operational frequency. In addition, a parasitic element that is unconnected to ground at only one end will have optimum performance when its effective length is about one-quarter wavelength of the operational frequency. The parasitic element can be floating, but it is preferred that the element be coupled to the tuning circuit 20 through the hinge 134 of the flip portion 132, using techniques known in the art. The tuning circuit 20 can adjust the effective length of the parasitic element for proper operation at multiple operational frequencies. The farther away the parasitic element 12 is located from a conductive surface the better its bandwidth enhancing properties. When the flip portion 132 is closed (not shown), its conductive body is removed from the presence of the antenna element 10 and no longer degrades its performance. Therefore, the parasitic element 12 is automatically coupled to the antenna element 10 only when it is needed (i.e. the flip is in the open position, as shown).

Figure 6:
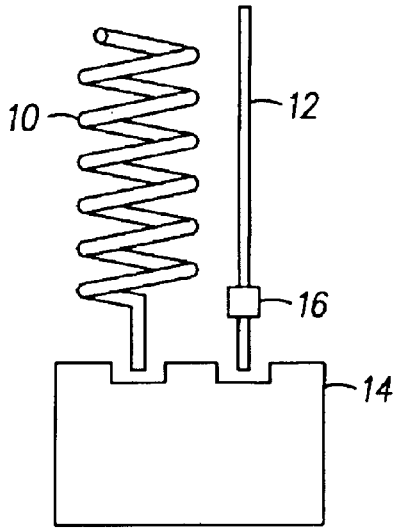
FIG. 6 is a representation of a fourth embodiment of an antenna apparatus, in accordance with the present invention.
Figure 7:
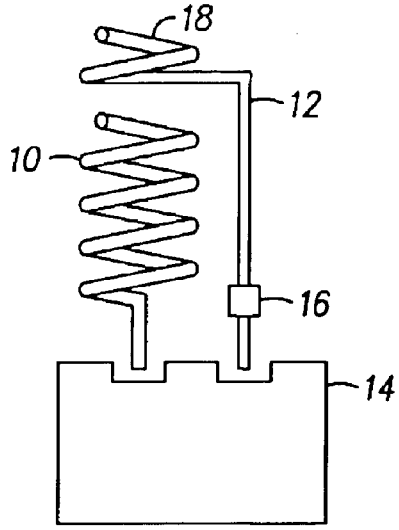
FIG. 7 is a representation of a fifth embodiment of an antenna apparatus, in accordance with the present invention.

An additional variation associated with the capacitively coupled family of embodiments for this invention is illustrated in FIGS. 6 and 7. In these embodiments, an inductively loaded parasitic element 12 is coupled to the antenna element 10 to improve bandwidth and radiation efficiency. The parasitic element 12 includes a series connected static inductor 16 near its base. In this illustration, the antenna and parasitic element are built on a cellular phone casing with RF grounded portions. Other ground planes, both on cellular phone designs and on other types of devices, could easily be envisioned for this variation. FIG. 7 is identical to the embodiment of FIG. 6 with the addition of a helical portion 18 that is coaxial with the helical structure of the antenna element 10. This element 18 provides additional coupling so as to reduce the value of the inductor 16 required.

The inductively loaded parasitic element creates a second resonance, that can be tuned with a static or dynamic matching network (such as 20 in FIG. 2) to increase the bandwidth of a narrow-banded antenna. The term "dynamic" as used herein can be interpreted in its conventional sense wherein the reactance of the matching network can be changed in real-time (i.e. dynamically) to tune the parasitic element. Such "dynamic" tuning can be accomplished through various techniques known in the art such as through: switching of discrete elements (shown as 20 in FIG. 2 and described in FIG. 3, for example) within the total reactance range of available discrete elements, and a variable capacitance tuned with a voltage, for example. This is particularly useful in the case of an antenna in the presence of a housing with RF grounded conductive portions that act to lower bandwidth and efficiency of the antenna. The inductively loaded parasitic wire can restore the bandwidth and efficiency of the antenna while maintaining low RF radiation exposure to a user.

Figure 8:
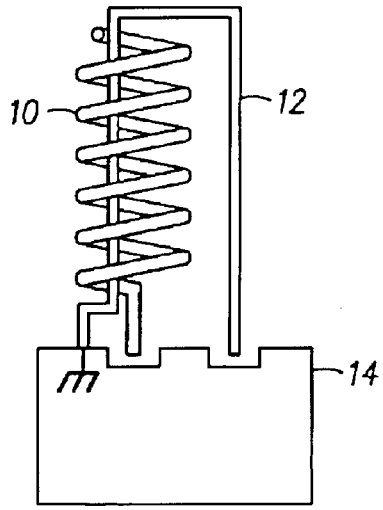
FIG. 8 is a representation of an alternate, preferred embodiment of an antenna apparatus, in accordance with the present invention.

FIG. 8 illustrates a preferred embodiment for the magnetic loop (inductively coupled) antenna family of this invention. As before, a plurality of parasitic elements and antenna elements can be in the present invention. The magnetic loop family of embodiments utilizes magnetic field or inductive coupling to transfer RF energy between the driven antenna element(s) and parasitic element(s). As in the capacitively coupled embodiments, the magnetic loop embodiments utilize at least one driven antenna element 10 and at least one parasitic element 12 that is in close proximity to the antenna element(s). The magnetic loop family of embodiments uses loop shaped parasitic elements that are connected to ground through a variable tuning load at one end and to signal ground at the other.

In particular, the parasitic element 12 in this particular embodiment forms a magnetic loop that rises on the outside parallel to the helix of the antenna element 10, bends over the top of, and runs down through the center of the helical antenna element 10 before terminating at signal ground. The magnetic loop couples to the collective magnetic field of the helical monopole. Variations in the tuning load on the magnetic loop affect the antenna's input impedance, changing the resonance of the antenna. As with the capacitively coupled embodiment, the length of the helix and the spacing between coils need to be adjusted with the parasitic element in place to obtain a desired frequency range. The PIN diode tuning circuit (FIG. 3), described earlier, can also be used with this embodiment. Simulations of this embodiment show the presence of second and third resonance points that are available to tune for extended bandwidth.

Figure 9:
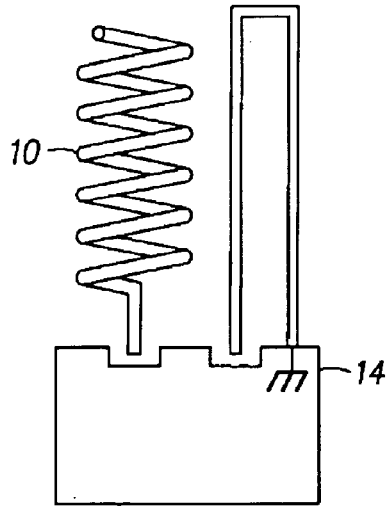
FIG. 9 is a representation of an alternate second embodiment of an antenna apparatus, in accordance with the present invention.

Alternative embodiments of the inductively coupled tunable antenna apparatus can be generated by changing the positioning, size, and/or type of the magnetic loop element or the type of antenna used. One specific alternative embodiment is shown in FIG. 9. In this embodiment, the parasitic element 12 is mounted completely outside of, and perpendicular to, the circumference of a helical antenna. Additional alternative geometries of the inductively coupled family of embodiments can be created by placing the magnetic loop parasitic element completely inside of the helical antenna element or by placing the driven antenna element inside the magnetic loop element.

Figure 10:
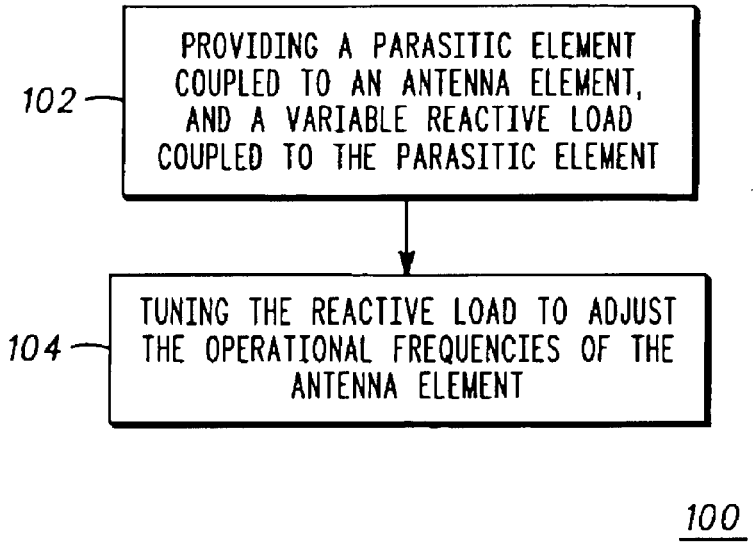
FIG. 10 is a flow chart of a method for antenna tuning, in accordance with the present invention.

Referring to FIG. 10, the present invention also includes a method 100 for tuning an antenna apparatus. The method includes a step 102 of providing a parasitic element electromagnetically coupled to an antenna element and a variable reactive load coupled to the parasitic element. The method 100 also includes a step 104 of tuning the reactive load to adjust the operational frequencies of the antenna element.

The previous description of the preferred embodiments is provided to enable any person skilled in the art to practice the preferred embodiments. Various modifications to these embodiments will be readily apparent to those skilled in the art, and the generic principles defined herein may be applied to other embodiments without the use of the inventive faculty. For example, the helical and straight wire representations for the antenna element and parasitic element can be reversed. Moreover, the helical and straight wire representations for the antenna element and parasitic element can be shared therebetween. Thus, those skilled in the art of cellular telephone antenna design will recognize that other antenna geometries can be used as the antenna/parasitic elements, depending upon the design parameters (e.g. cost, size, antenna directivity, etc.). Moreover, the tuning circuits can be continuously variable instead of discretely variable as described.

In summary, it should be recognized that the present invention is a radiotelephone antenna tuning improvement that optimizes a radiotelephone's operational frequency and bandwidth to provide improved transmit and receive efficiency over multiple bands. As a result, the invention also reduces current draw and extends battery life by allowing the power amplifier of the radiotelephone to operate at a lower power. As such, its benefits apply to any sort of antenna element or exciter. Although a typical helical monopole example is given, the invention is equally applicable to other antenna structures like printed wire antennas or planar inverted F antennas, and the like, as are known in the art.

It is to be understood that the phraseology or terminology employed herein is for the purpose of description and not of limitation. Accordingly, the invention is intended to embrace all such alternatives, modifications, equivalents and variations as fall within the broad scope of the appended claims.

What is claimed is:

1. A radio communication device with an antenna apparatus comprising:

an antenna element;

a parasitic element located in proximity to the antenna element and electromagnetically coupled thereto; and a tuning circuit coupled to the parasitic element and loading the parasitic element, the tuning circuit being dynamically variable by varying a reactance of the tuning circuit in real-time to adjust the operational frequencies of the antenna element coupled to the tuned parasitic element, wherein the parasitic element is electrically connected to the tuning circuit at one end and is unconnected at the other end, and wherein the tuning circuit is coupled to ground.

2. The device of claim 1, wherein the parasitic element is capacitively coupled to the antenna element.

3. The device of claim 1, wherein the parasitic element is inductively coupled to the antenna element.

4. The device of claim 1, wherein the antenna element is a helical structure, and the parasitic element is a wire that rises parallel to the outside of the helix and then extends over the top and down into the helical structure of the antenna element.

5. The device of claim 1, wherein the antenna element is a helical structure and the parasitic element is a wire that extends upwards through a portion of the helical structure of the antenna element and parallel to an axis thereof.

6. The device of claim 1, wherein the antenna element is a helical structure, and the parasitic element includes a plate in proximity to a circumference of the helix.

7. The device of claim 6, wherein the plate is disposed on a flip portion of the device moveable between an open and closed position, the plate coupling with the antenna element when the flip portion is in the open position.

8. The device of claim 1, wherein the parasitic element includes an inductive element in series therewith.

9. The device of claim 8, wherein the antenna element is a helical structure and the parasitic element includes a helical portion that is coaxial with the helical structure of the antenna element.

10. The device of claim 1, further comprising a variable matching circuit coupled to the antenna element, the variable matching circuit operable to retune the antenna apparatus to compensate for changes affected by the tuning circuit.

11. A radio communication device with an antenna apparatus comprising:

an antenna element;

a parasitic element located in proximity to the antenna element and electromagnetically coupled thereto; and a tuning circuit coupled to the parasitic element and loading the parasitic element, the tuning circuit being dynamically variable by varying a reactance of the tuning circuit in real-time to adjust the operational frequencies of the antenna element coupled to the tuned parasitic element, wherein the parasitic element is electrically connected to the tuning circuit at one end and is connected to ground at the other end, and wherein the tuning circuit is coupled to ground.

12. The device of claim 11, wherein the antenna element is a helical structure, and the parasitic element is a wire loop that rises parallel to the outside of the helix and then extends over the top and down through the center of the helical antenna element and terminates at ground to form a magnetic loop.

13. The device of claim 11, wherein the antenna element is a helical structure, and the parasitic element is a wire loop that rises and falls parallel to the outside of the helical antenna element and perpendicular to the circumference of a helical antenna element and terminates at ground to form a magnetic loop.

14. The device of claim 11, wherein the antenna element is a helical structure and the parasitic element is a wire loop that rises and falls parallel and completely within the helical antenna element and terminates at ground to form a magnetic loop.

15. A radio communication device with an antenna apparatus comprising:

a helical antenna element;

a parasitic element located in proximity to the antenna element and capacitively coupled thereto; and a tuning circuit coupled between the parasitic element and ground and loading the parasitic element, the tuning circuit being dynamically variable by varying a reactance of the tuning circuit in real-time to adjust the operational frequencies of the antenna element coupled to the tuned parasitic element.

16. The device of claim 15, further comprising a variable matching circuit coupled to the antenna element, the variable matching circuit operable to retune the antenna apparatus to compensate for changes affected by the tuning circuit.

17. The device of claim 15, wherein the parasitic element is a wire, a portion of which runs parallel to an axis of the helix.

18. The device of claim 15, wherein the parasitic element includes an inductive element in series therewith.

19. A method for tuning an antenna apparatus, the method comprising the steps of:

providing a parasitic element electromagnetically coupled to an antenna element and a variable reactive load coupled to the parasitic element; and dynamically tuning the reactive load by varying a reactance of a matching circuit connected to the reactive load in real-time to adjust the operational frequencies of the antenna element coupled to the tuned parasitic element.

* * * * *